US007282088B2

(12) United States Patent
Nittel et al.

(10) Patent No.: US 7,282,088 B2
(45) Date of Patent: Oct. 16, 2007

(54) METHOD FOR COPPER-PLATING OR BRONZE-PLATING AN OBJECT AND LIQUID MIXTURES THEREFOR

(75) Inventors: Klaus-Dieter Nittel, Frankfurt (DE); Ralf Schneider, Frankfurt (DE)

(73) Assignee: Chemetall GmbH, Frankfurt (DE)

( * ) Notice: Subject to any disclaimer, the term of this patent is extended or adjusted under 35 U.S.C. 154(b) by 118 days.

(21) Appl. No.: 10/509,586

(22) PCT Filed: Apr. 2, 2003

(86) PCT No.: PCT/EP03/03427

§ 371 (c)(1),
(2), (4) Date: Jul. 15, 2005

(87) PCT Pub. No.: WO03/085167

PCT Pub. Date: Oct. 16, 2003

(65) Prior Publication Data

US 2006/0090669 A1 May 4, 2006

(30) Foreign Application Priority Data

Apr. 4, 2002 (DE) ..... 102 14 859

(51) Int. Cl.
*C23C 18/38* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS 4,036,651 A * 7/1977 Weiner ..... 106/1.26
4,303,443 A * 12/1981 Miyazawa et al. ..... 106/1.23
4,954,369 A 9/1990 Oftring et al.
5,221,328 A * 6/1993 Bishop et al. ..... 106/1.23
5,776,231 A 7/1998 Nittel et al.
6,261,644 B1 7/2001 Nittel et al.
6,709,563 B2 * 3/2004 Nagai et al. ..... 205/123
2004/0253450 A1 * 12/2004 Seita et al. ..... 428/411.1

FOREIGN PATENT DOCUMENTS

| | | | |
|---|---|---|---|
| DE | 41 11 558 | C1 | 1/1992 |
| DE | 44 40 299 | A1 | 5/1996 |
| DE | 199 18 833 | A | 10/2000 |
| GB | 1425 298 | A | 2/1976 |
| WO | WO-92 17624 | A | 10/1994 |

OTHER PUBLICATIONS

Derwent abstract of DE 19918833, Oct. 2002.*
Derwent abstract of DE 4111558, Jan. 1992.*

* cited by examiner

*Primary Examiner*—Helene Klemanski
(74) *Attorney, Agent, or Firm*—Fulbright & Jaworski L.L.P.

(57) ABSTRACT

The invention relates to an aqueous concentrate which is stable with respect to freezing and defrosting and which contains at least one water-soluble or water-dispersible copper compound and, optionally, also a water-soluble or water-dispersible tin compound for use in a diluted state as a bath for the currentless copper plating or bronze plating of objects, especially metal objects such as iron or steel wires, characterized in that it contains at least one complexed water-soluble or water-dispersed copper compound. The invention also relates to an aqueous bath which contains at least one aqueous or water-dispersible copper compound and, optionally, a water-soluble or water-dispersible tin compound for the currentless copper plating of objects in addition to at least one brightening agent and which has an adjusted pH value of less than 2.5. The invention also relates to a method for currentless copper plating or bronze plating of an object, especially a metallic object.

14 Claims, No Drawings

METHOD FOR COPPER-PLATING OR BRONZE-PLATING AN OBJECT AND LIQUID MIXTURES THEREFOR

This is a §371 of PCT/EP03/03427 filed Apr. 2, 2003, which claims priority from German 102 14 859.7 filed Apr. 4, 2002, each of which are hereby incorporated by reference in their entirety The present invention relates to a process for the currentless coppering (copper coating) or bronzing (bronze coating) of an object, in particular a metallic object, more particularly an object of a ferrous material, above all an iron wire, steel wire or a wire-containing aggregate such as for example a wire mesh, with an aqueous bath containing dissolved copper.

The object of coppering or bronzing is not only to protect the surfaces of the objects to be coated by means of the copper-containing coating against corrosion, but also to form a coating that is as uniform, shiny and adherent as possible. In this connection a peel resistance (adherence) on bending a wire for example as well as a layer weight roughly in the range from 0.8 to 24 g/m$^2$, in particular in the range from 1 to 18 g/m$^2$, are desired. The coppering or bronzing bath should be suitable for currentless metallising.

Up to now coppering baths for this purpose are known in which the bath is prepared using a pulverulent copper-rich concentrate, water and sulfuric acid. The baths may for example contain apart from copper sulfate, also sodium chloride, a magnesium salt, a brightening agent and optionally further additives. The powder at the same time offers the possibility of holding comparatively high copper contents in the concentrate and thus of transporting comparatively low weights.

Water and sulfuric acid are normally available in situ or can be obtained nearby. Such pulverulent concentrates often have a copper content in the range from 12 to 22 wt. % Cu. The concentrates are very sensitive to moisture on account of the high content of copper sulfate, and their quality depends in particular on the freedom from or on the nature and amount of the impurities and/or additives. On account of the sensitivity to moisture and the chemical reactions occurring in the powder as a result of the moisture, the storage life of the pulverulent concentrates is often limited. Changes are initially manifested by a green colouration and subsequently end in agglomerations. The pulverulent concentrate, which is often stored for months, is made up in situ with water and sulfuric acid before coppering, and the coppering bath is in many cases maintained ready for use over several weeks and is replenished as necessary. The pulverulent concentrate often requires prolonged stirring or agitation and possibly heating to a slightly elevated temperature, such as for example up to 60° C. Since the coppering bath is however normally kept and used in premises that can be heated as necessary, there is normally no need for the bath to be stable with regard to freezing and thawing. Furthermore the requirements as regards the industrial use also of concentrates and baths for coppering are becoming increasingly stringent.

On account of the often months-long storage and the in some cases fairly long transportation of concentrates to the currentless coppering and bronzing site, there was a need to develop a concentrate that can be stored if possible for several months and that can be transported without any problem in various climatic regions. In the case of a liquid concentrate a concentrate has to be developed that also does not cause any problems as regards freezing and thawing, since once coppering solutions have been frozen they no longer independently form homogeneous solutions. Also, an addition of antifreeze agents does not help since the salts precipitate in any case and form a floor sediment. Accordingly in practice virtually only pulverulent concentrates or, in exceptional cases, two-component concentrates are produced with copper sulfate solution as well as with a separately stored liquid mixture of brightening agent and other sensitive liquids. Up to now no liquid concentrate for currentless coppering or bronzing is known to the Applicant that contains all or virtually all the components needed for coppering or bronzing.

In addition the object existed of providing a concentrate and a process for currentless coppering or bronzing that is as environmentally friendly as possible and that moreover has as safe a pH value as possible. These concentrates should in addition be able to be used easily, without complications and efficiently for the coppering or bronzing. The concentrate should have as high a copper content as possible. The bath prepared from the concentrate inter alia by dilution should form high-gloss, solid, firmly adhering copper coatings. It would be advantageous if this concentrate were to contain all the components for the currentless coppering or bronzing.

It has been established that an aqueous copper-rich concentrate in which a large part of the copper content is present in complexed form can exist as a solid homogeneous mass below the freezing point and can rapidly re-form into a homogeneous aqueous mixture on thawing, without having to be stirred or agitated.

This object is achieved with an aqueous concentrate that is stable on freezing and thawing that contains at least one water-soluble or water-dispersible copper compound and optionally also a water-soluble or water-dispersible tin compound for use in the diluted state as a bath for the currentless coppering or bronzing of objects, in particular metallic objects such as for example iron or steel wires, which is characterized in that it contains at least one complexed water-soluble or water-dispersed copper compound.

Preferably all compounds present in the concentrate are dissolved or dispersed in water. The complexing agent may be contained in stoichiometric amount, in a sub-stoichiometric amount or in excess. Preferably the concentrate contains a basic copper carbonate or at least one compound formed therefrom by complexing with a complex-forming agent. On account of the complexing a high copper content can be maintained in the solution without precipitation occurring.

The mixture may be repeatedly frozen at low temperatures down to at least −14° C. and may be thawed without the quality of the mixture, in particular the quality of the coppering bath prepared therefrom, being adversely affected. This mixture normally serves as a concentrate that can be transported as a liquid product and that by dilution and optionally by addition of individual additives can be made up into a coppering bath, or at the same time can be used as a replenishment solution to replenish the copper content and the contents of the further components of such a bath, in particular a coppering bath.

This mixture is according to the knowledge of the Applicant the first product that can durably be stored as a non-pulverulent Cu-containing concentrate for at least one month and possibly even several years under normal conditions, and that can withstand a cold stability test at −14° C. for at least one week without any problem. It is therefore the first non-pulverulent product that can be transported overseas and used there without any problem since pulverulent copper-rich concentrates are always extremely hygroscopic and undergo chemical changes relatively quickly and markedly. A suitable alternative to bronzing is provided with a tin content of at least 0.01 g/l Sn. The tin content is preferably 0.5 to 20 wt. % of the sum total of all metals or metal ions that are required for the alloy composition of the bronze, and is in particular 1 to 25 wt. % and preferably 2 to 15 wt. % of the amount of copper employed.

The bath is preferably largely or wholly free of halides and/or anions, in particular halides and/or anions such as chloride and/or nitrate, though halides and/or anions may also be entrained from other baths.

The concentrate according to the invention is preferably free or largely free of cyanides, diphosphates, phosphates, sulfamates, borates, bromides, fluorides, fluoroborates and/or iodides. The substantial or complete freedom from these and possibly also other anions is significant in order that the anions do not lead to the precipitation of salts when the aqueous solution is cooled below the freezing point and accordingly do not affect the stability as regards freezing and thawing. This is due to the fact that hydrated copper sulfate can precipitate only in the presence of anions. Preferably these anions and heavy metals are not intentionally added, apart from copper, possibly apart from tin and possibly also apart from further alloying constituents of the copper-rich coating to be formed. Preferably the concentrate and/or bath according to the invention is also free or largely free of other heavy metals such as for example cadmium, gold, cobalt, manganese, nickel, silver and/or further steel-finishing additives, in which connection contents of heavy metals that are dissolved out from the metallic material to be coated and which derive from the raw materials or are entrained from other baths often cannot be avoided. In the case of particularly high amounts of complexed compounds it is preferred to add the complexing agent in the preparation of the concentrate in an approximately stoichiometric ratio to the content of copper and possibly also tin or even in a hyperstoichiometric amount (approximately of the order of magnitude of ca. 1:1), particularly preferably in the range from (0.9-1.2):1, most particularly preferably in the range from (0.96-1.10):1 and above all in the range from (0.99-1.05):1.

The concentrate according to the invention should contain at least 40 wt. % of the contained copper compounds in complexed form. Preferably at least 50 wt. % of the contained copper compounds, more preferably at least 60 wt. %, most particularly preferably at least 70 wt. %, in particular at least 80 wt. %, more particularly preferably at least 90 wt. % and above all at least 95 wt. % of the contained copper compounds are in complexed form. Preferably the copper compounds and possibly also tin compounds are largely or wholly complexed. Other alloying constituents may also be largely or wholly complexed. In addition, at least one tin compound may also be present in complexed form. Apart from the copper complex compounds, possibly preferably hydrated copper sulfate and/or similar copper or tin compounds may be included.

The concentrate may contain at least one copper compound that is at least partially complexed with a complex-forming agent based on at least one complexing monohydroxycarboxylic, dihydroxycarboxylic, trihydroxycarboxylic and/or polyhydroxycarboxylic acid, phosphonic acid, diphosphonic acid and/or at least one of their derivatives. The complex-forming agent is preferably based on citric acid, gluconic acid, lactic acid, tartaric acid, phosphonic acid, diphosphonic acid, chemically related acids and/or one of their derivatives. The addition of the at least one complex-forming agent may take place inter alia in the form of an acid, salt and/or organic compound, in particular of an alkali metal, alkaline earth metal and/or ammonium. The complexed copper and/or tin compounds are preferably citrates, gluconates, lactates, tartrates, phosphonates, diphosphonates and/or their derivatives or chemically related compounds.

The concentrate is stable to freezing and thawing preferably down to at least −8° C. In particular it is stable to freezing and thawing down to at least −14° C., preferably down to at least −20° C. and particularly preferably down to at least −25° C. Stability to freezing and thawing within the context of the present invention means that the aqueous mixture can be repeatedly cooled to temperatures down to for example −20° C., for example under normal storage conditions such as in the open air in Winter, and that the mixture is ready for use after heating to temperatures significantly above the freezing point of the aqueous mixture even without stirring or agitation and/or without prolonged waiting until all the constituents have dissolved to form a homogeneous solution. In the fresh state the bath is dark blue, at a certain iron content is greenish, and after long use is, depending on the circumstances, brownish-black on account of the dissolved iron. In the case of high contents of complexed compounds instead of salts in the aqueous mixture, scarcely any such floor sediment or no floor sediment at all is formed and there is scarcely any or no differentiation in regions with high and low metal contents. Accordingly the bath produced from the concentrate by dilution may also be stable to freezing and thawing, though not necessarily so.

The concentrate preferably has a copper content in the range from 3 to 200 g/l Cu, more preferably at least 15 g/l, particularly preferably at least 30 g/l, most particularly preferably at least 60 g/l, or preferably at most 160 g/l, particularly preferably at most 130 g/l and most particularly preferably at most 110 g/l.

In principle a pH value may be chosen in a wide pH range. Advantageously the concentrate is adjusted to a pH value in the range from 4 to 11. Preferably the concentrate has a pH value in the range from 5 to 10, particularly preferably in the range from 6 to 9, and most particularly preferably in the range from 7 to 8. The adjustment may be made inter alia with at least one base such as for example NaOH, KOH and $NH_4OH$ and/or with at least one amine. If the concentrate has a pH of about 7, it may be termed as dermatologically neutral.

The concentrate advantageously contains at least one copper compound that is at least partially complexed with a complexing agent based on at least one monohydroxycarboxylic, dihydroxycarboxylic, trihydroxycarboxylic and/or polyhydroxycarboxylic acid, phosphonic acid, diphosphonic acid and/or chemically related compound and/or at least one of their derivatives.

The object of the present invention is also achieved with an aqueous bath that contains at least one water-soluble or water-dispersible copper compound and also a water-soluble or water-dispersible tin compound for the currentless coppering or bronzing of objects, in particular metallic objects such as for example iron-containing wires, as well as at least one complexed copper compound and at least one brightening agent, the said bath being adjusted to a pH value of less than 2.5.

Preferably all compounds present in the bath are dissolved or dispersed in water. An addition of tin and optionally generally minor amounts of other alloying constituents may advantageously be made in the form of water-soluble or water-dispersed compounds such as tin hydroxide, tin carbonate and/or at least one organotin compound such as for example at least one tin alcoholate or similar compounds of the further alloying constituents that are possibly used in the preparation of the bath, i.e. starting from the concentrate. The amount of tin added to the bath may in particular be in the range from 0.03 to 8 g/l Sn. The concentrate and/or bath according to the invention is preferably free or largely free of cyanides, diphosphates, phosphates, sulfamates, borates, bromides, fluorides, fluoroborates and/or iodides. The bath may however contain halide, in particular halide entrained from the upstream pickling baths. Preferably these anions and heavy metals, apart from copper, tin and possibly further alloying constituents of the copper-rich coating that is to be formed, are not added intentionally. Preferably the concentrate and/or bath according to the invention is free or largely free of other heavy metals such as for example cadmium, gold, cobalt, manganese, nickel, silver and/or further steel-finishing additives, in which connection contents of heavy metals that are dissolved out from the metallic material to be coated, that are derived from the raw materials or that are entrained from other baths, often cannot be avoided or cannot be sufficiently avoided.

In the aqueous bath at least 40 wt. % of the contained copper compounds may be complexed, preferably at least 50 wt. %, more preferably at least 60 wt. %, most particularly preferably at least 70 wt. %, in particular at least 80 wt. %, most particularly preferably at least 90 wt. % and above all at least 95 wt. %. Furthermore at least one tin compound may also be complexed. Apart from the copper complex compounds, hydrated copper sulfate, copper chloride and/or similar copper or tin compounds may for example be contained. Preferably the bath contains a basic copper carbonate or the at least one compound formed therefrom by complexing.

The bath may advantageously have a copper content in the range from 0.05 to 120 g/l. Preferably the copper content of the bath is at least 0.1 g/l, particularly preferably at least 0.2 g/l, most particularly preferably at least 0.4 g/l, or preferably at most 100 g/l, particularly preferably at most 70 g/l and most particularly preferably at most 45 g/l. For the coppering of wires copper contents of the bath above all in the range from 0.5 to 35 g/l Cu are suitable for throughflow processes as well as for dipping processes, in particular contents of about 22 to 25 g/l.

The bath may have a dissolved iron content of up to at least 90 g/l or even up to at least 110 g/l $Fe^{2+}$, and despite this may in principle be capable of use. The bath may in certain circumstances be operated with an even higher dissolved iron content.

The bath may contain at least one copper compound that is at least partially complexed with a complex-forming agent based on at least one complexing monohydroxy-carboxylic, dihydroxycarboxylic, trihydroxycarboxylic and/or polyhydroxycarboxylic acid, phosphonic acid, diphosphonic acid and/or at least one of their derivatives. Preferably the complex-forming agent is one containing 4 to 12 carbon atoms, in particular citric acid, gluconic acid, lactic acid, tartaric acid, phosphonic acid, diphosphonic acid and/or one of their derivatives, in particular at least one alkali metal, ammonium or alkaline earth metal citrate, alkali metal, ammonium or alkaline earth metal gluconate, alkali metal, ammonium or alkaline earth metal acetate and/or alkali metal, ammonium or alkaline earth metal tartrate or analogous phosphonates and/or diphosphonates. The addition of the at least one complex-forming agent may take place inter alia in the form of an acid, salt and/or organic compound of an alkali metal, alkaline earth metal and/or ammonium. Part of the iron content taken up in the bath is likewise complexed in the process according to the invention. The complexed copper, tin and/or iron compounds are preferably citrates, gluconates, lactates, tartrates, phosphonates, diphosphonates and/or their derivatives. It was found from experience that an excessive amount of the complex-forming agent and of the brightening agent does not have a damaging effect.

The bath may have a content of reacted or unreacted complex-forming agent in the range from 0.1 to 400 g/l, jointly calculated as unreacted complex-forming agent. Preferably the content is at least 1 g/l, particularly preferably at least 2 g/l, most particularly preferably at least 4 g/l, or preferably at most 150 g/l, particularly preferably at most 100 g/l and most particularly preferably at most 60 g/l.

The bath may have a content of at least one brightening agent, in particular a brightening agent with a content of amide, amine, imide, imine, polymeric aminoalcohol, polyamide, polyamine, polyimide, polyimidazoline and/or polyimine. Advantageously a brightening agent is selected that is stable in the pH range from 4 to 11 and that functions efficiently. Preferably the brightening agent contains at least one compound based on dimethylamine, hexamethyleneamine, propylamine or corresponding imine, amide or imide and/or oxirane, particularly preferably polymeric compounds based on the latter, above all polymeric compounds based on amine with epichlorohydrin, in particular those with propylamines and/or tetramines, most particularly preferably polymeric compounds based on dimethylaminopropylamine and/or hexamethylenetetramine with epichlorohydrin.

The bath may have a content of at least one brightening agent in the range from 0.05 to 20 g/l. Preferably its content is at least 0.2 g/l, particularly preferably at least 0.5 g/l, most particularly preferably at least 1 g/l, or preferably at most 12 g/l, particularly preferably at most 8 g/l and most particularly preferably at most 4 g/l.

The bath may also have a content of at least one pickling agent, in particular at least one halide of an alkali metal, alkaline earth metal and/or of ammonium and/or at least one acid, in particular at least one mineral acid. The pickling agent is preferably an alkali metal chloride, alkali metal bromide or alkali metal fluoride such as for example KCl, NaCl, NaBr, NaF, and/or at least one acid such as for example hydrochloric acid and/or hydrofluoric acid. Preferably pickling agent is added in an amount, generally a minor amount, such that a weak additional pickling effect is produced that facilitates the dissolution of the baser metal ions from the surface. It is not at all necessary to add at least one pickling agent, though the use thereof is advisable if the surfaces are particularly passive and it is also scarcely feasible to carry out a sulfuric acid pickling.

The bath may be adjusted to a pH value in the range less than 2.5. Preferably the bath has a pH value in the range up to 2.0, particularly preferably a range around 1.0 or at most 1.0. The adjustment may advantageously be carried out inter alia with acids such as for example sulfuric acid and/or other sulfur-containing acids.

The bath may contain at least one lubricating additive that is water-soluble and/or water-dispersible, and/or that allows at least one lubricating additive to separate out during the coppering or bronzing. The lubricating additive should for example improve the frictional behaviour in wire manufacture and reduce the cutting action of the wire, on for example plastics elements; it may be a typical lubricant, but may however also in each case be at least one high molecular weight polyglycol, an ester, a high molecular weight surfactant, a high molecular weight fatty acid or one of their derivatives, such as for example at least one fatty acid ester, in particular at least one fatty acid polyglycol ester and/or fatty acid polyglycol ether.

The bath may be stable to freezing and thawing down to at least −8° C. Preferably it is stable to freezing and thawing down to at least −14° C., particularly preferably down to at least −20° C. and most particularly preferably down to at least −25° C. The freezing and thawing stability is not necessary for a bath that is normally used in premises that can be heated. Also, the freezing and thawing stability of the bath depends to a large extent on the substantial or complete freedom from anions apart from sulfate.

In principle the bath can be prepared from the concentrate according to the invention by dilution with water and optionally under the addition of in each case at least one acid, salt, brightening agent, pickling agent and/or further additive.

The object of the present invention is furthermore achieved by a process for the currentless coppering or bronzing of an object, in particular a metallic object, with an aqueous bath according to the invention that is formulated from a concentrate according to the invention by addition of water and if necessary in each case by addition of at least one acid, salt, brightening agent, pickling agent and/or further additive to the ready-for-use aqueous bath for the coppering or bronzing.

The dilution of the concentrate to form the bath is preferably carried out at dilution factors in the range from 2 to 50, particularly preferably in the range from 4 to 30, most particularly preferably in the range from 6 to 20. In this connection the pH of the bath may be adjusted to values around or below 1.0 and maintained in this range of values. In the coppering of steel wires a treatment time for coppering by dipping of 30 to 180 sec. was hitherto customary. Preferably the object to be metallised by dipping is contacted with the bath liquid for a time ranging from 0.1 to 8 minutes, and in throughflow metallising for a time ranging from 0.1 to 30 seconds. In particular metallising is carried out at a bath temperature in the range from 5° to 80° C., preferably in the range from 10° to 70° C., in the case of dipping especially in the range from 15° to 60° C., in throughflow metallising especially in the range from 20° to 65° C. and most especially in the range from room temperature to 45° C. A coating with a copper content of 0.1 to 40 g/m$^2$ can be applied in this way. In the coppering of wires, amounts of copper in particular in the range from 0.5 to 4 g/m$^2$ Cu can be deposited in the throughflow method, and amounts in the range from 1 to 20 g/m$^2$ Cu can be deposited in the dipping method. The layer thicknesses of the copper coating are generally up to 5 μm. Surprisingly, metallising can often still be carried out with a dissolved iron content of the bath of up to 90 or even up to 110 g/l $Fe^{2+}$.

Before contact with the bath liquid the object to be metallised or possibly the metallic object can first of all be cleaned under alkaline conditions and/or pickled under acidic conditions in a currentless and/or electrolytic process and following this may also be rinsed with water if necessary. After the currentless coppering or bronzing the metallised object may then be rinsed, optionally dried, optionally treated with a passivating agent and optionally re-rinsed, optionally annealed and, in the case of wires, optionally also be drawn at least once.

Normally coppering dipping baths can only handle an iron content of at most only 80 g/l, in particular often only up to 60 g/l or even less, as a result of which the bath has to be replaced when the operating limit is reached, which in the case of throughflow plants is generally already in the range from 15 to 30 g/l $Fe^{2+}$ and in dipping plants is, depending on the circumstances, only in the range from 60 to 80 g/l $Fe^{2+}$ (always as dissolved fraction), since the amount of deposited copper continues to fall per unit time with the iron content of the bath. At least part of the bath then has to be discarded. Because of this low operating limit, which is quickly reached on account of the dissolution of the iron in the pickling of the metallic, generally steel object, to be coated, the bath volumes are often small. However in the case of conventional coppering baths initial adverse effects, which lead to an initial reduction of the layer weight per unit time (=deposition rate) and of the adherence of the copper-rich layer to the metallic substrate, already occur in some cases starting with dissolved iron contents of 5 g/l $Fe^{2+}$. In addition, for a good and efficient copper deposition it is necessary for the object being metallised to be thoroughly cleaned, in particular for organic contamination to be removed.

It appears possible in this way for the first time to be able to raise the operating limit of the dipping bath to a range of at least 90 g/l $Fe^{2+}$ or even to a range of at least 110 g/l $Fe^{2+}$. The dipping bath may in some cases be able to operate possibly with an even higher dissolved iron content.

In addition it appears possible for the first time to be able to raise the copper content of a concentrate or bath for currentless coppering or bronzing to concentrations far in excess of 25 g/l Cu, and to maintain the content approximately at this order of magnitude. With the higher copper concentration of the bath it is also possible to establish a higher deposition rate and to produce a high layer weight in a shorter time.

Finally, it appears possible for the first time to be able successfully to develop a permanently storable concentrate or bath for currentless coppering or bronzing that in addition is also stable to freezing and thawing.

It was surprisingly found that the bath according to the invention does not lose its operational capability for coppering when iron contents in the range from about 15 to 30 g/l $Fe^{2+}$ referred to dissolved iron contents are reached, as is at present normally the case with processes for currentless coppering, but instead remains functional up to contents of about 90 to 110 g/l $Fe^{2+}$. Not only the copper deposition rate but also the adhesion strength and gloss of the coating remain at a very high quality up to this high operating limit. Since on account of the electrochemical series the deposition of copper takes place by the dissolution of a less noble metal such as iron, iron ions rapidly accumulate in the bath. In this connection there is no iron precipitation at the low pH value of far less than 2.5. If the dissolved iron content in the bath becomes higher, the voltage difference in the bath corresponding to the Nernst equation is no longer sufficiently high to cause the deposition of the nobler metal. With increasing iron content in the bath the copper deposition rate, the adherence of the copper coating and the gloss of the coating all decrease. Obviously the negative influence of the iron content is obviated to a large extent by the nature of the complexing, in particular when using citrate. With the cementation of the copper the complex-forming agent becomes free again and can obviously complex the released $Fe^{2+}$ ions. Corresponding to the Nernst equation the copper concentration appears on account of the complexing to be at higher values in relation to the iron concentration. In this way the cathodic partial reaction could be displaced to values corresponding to nobler metals and lead to an increase in the coppering rate and to higher layer weights. Possibly the copper-citrate complex is also less stable than the corresponding iron-citrate complex.

On account of the higher iron uptake of the bath the latter can be used for a multiple of the normal time without interruption, before the high iron content is rectified by discarding at least part of the bath. The bath contents can then be replenished by adding further concentrate containing all the components. Advantageously only the concentrate is used as replenishment solution.

It was surprisingly found that the adherence of the copper-rich coating to the substrate does not drop sharply as is usual with a marked increase in the layer weight of the copper-rich coating. In fact, a decrease in the layer weight from values of for example around about 2 g/m$^2$ to about half or even a quarter of this value is normally unavoidable, especially when coppering wires.

It was also found that a certain amount of brightening agent in the bath is necessary. However, an extra amount does not have any disadvantages, apart from the additional expense.

The concentrate according to the invention is easily transportable, can be stored for at least six months, and is sufficiently stable to freezing and thawing for transportation and storage.

The liquid concentrate has the following advantages compared to a solid concentrate: 1. there are no problems or expenditure involved in dissolving aggregates of the copper compounds such as for example copper sulfate (formation of lumps), which on account of the hygroscopic behaviour of the powder clump together and cause problems when metered in in an automated manner, 2. no halide has to be included, and accordingly a neutral or slightly alkaline pH that is friendly to the skin can be adjusted, 3. there are no rapid uncontrolled secondary reactions on account of the hygroscopic behaviour of the copper compound and additives such as sodium chloride, 4. a concentration equilibrium over the length of the treatment bath is ensured sufficiently quickly since the copper consumed in the bath has to be metered into the bath substantially continuously via the concentrate, 5. there are no problems or extra expenditure involved in the metering of the concentrate since only one vessel, a hose connection and a pump are required, 6. there is no extra expenditure in the transportation of highly acidic products, 7. the concentrate is a one-component product and 8. may, if necessary, already contain all the substances for the coppering or bronzing. Delivery of the liquid concentrate to other countries may therefore now be recommended, which is not the case with pulverulent concentrates.

The bath according to the invention and the metallising process according to the invention are particularly suitable for the currentless coppering or bronzing of wires or assemblies containing wires. The bath or process may be particularly successfully used for the metallising of all types of wires, such as for example tyre inlay wire, paperclip wire, electrodes, mattress spring wire, welding wire, decorative wire applications, etc. The metallising may however also be used as a forming aid or mould release agent, for example in flow pressing such as in steel slugs and for many other purposes. Such slugs can readily be deformed in the coppered state at 300° to 350° C. in flow pressing.

EXAMPLES AND COMPARISON EXAMPLES

An initial bath was prepared based on water, anhydrous citric acid (complexing agent), sodium hydroxide, sulfuric acid and copper hydroxycarbonate (=basic copper carbonate), $CuCO_3.Cu(OH)_2$, which contained, as converted values, 31.3 g/l of sodium citrate, 55 g/l of 96% sulfuric acid and 9.98 g/l of copper (comparison example 1). This composition also did not contain any brightening agent. Tap water was used to prepare the bath. The pH value before the addition of the sulfuric acid was almost exactly 7, adjusted by adding the appropriate amount of sodium hydroxide. Sulfuric acid was added last, the pH value then being about 1.2. At least one liquid or solid additive was mixed with this bath as necessary, and as brightening agent for all the examples according to the invention there was added a product based on a polymeric reaction product of dimethylamino-propylamine and epichlorohydrin (Examples 2 ff. and comparison examples).

Wire rods with a carbon content of 0.65 wt. % and 5.5 mm diameter were dipped in these baths, for example for 2 minutes at 30° C. (Table 1). The dipping time is calculated from the start of dipping up to the removal of the rods from the bath. In addition the coppering was investigated with regard to the dependence on time and temperature via the copper layer weight obtained in each case by dipping and, parallel thereto, in a throughflow unit with a bath composition according to Example 10. Following this the copper layer weight was determined as a function of the dissolved iron-II ion content—simulated in a dipping bath at 30° C. or for a throughflow unit at 50° C.—for a bath composition according to Example 10. The results are summarised in Tables 1-3.

Comparison examples 1 to 5 and examples 1 to 10 ACCORDING to the invention:

The additives specified in Table 1 were added to the initial bath mentioned above. The wire rods were dipped in this bath under the specified standard conditions. The determined properties are shown in Table 1.

TABLE 1

Composition and properties of the various baths complementing the data in comparison example 1, and properties of the coppered wires; additions in g/l unless otherwise specified.

| | VB 1 | VB 2 | VB 3 | VB 4 | VB 5 | B 1 | B 2 | B 3 | B 4 | B 5 | B 6 | B 7 | B 8 | B 9 | B 10 |
|---|---|---|---|---|---|---|---|---|---|---|---|---|---|---|---|
| Brightening agent | 0 | 0 | 0 | 0 | 0 | 0.01 | 0.1 | 1 | 15 | 0.1 | 0.1 | 0.1 | 0.1 | 0.1 | 0.1 |
| NaCl | 0 | 5 | 0 | 0 | 0 | 5 | 5 | 5 | 5 | 1 | 0 | 0 | 0 | 1 | 0 |
| NaBr | 0 | 0 | 5 | 0 | 0 | 0 | 0 | 0 | 0 | 0 | 5 | 0 | 0 | 1 | 0 |
| HCl 37% | 0 | 0 | 0 | 2 ml | 0 | 0 | 0 | 0 | 0 | 0 | 0 | 2 ml | 0 | 0 | 0 |
| $MgSO_4$ | 0 | 0 | 0 | 0 | 2 | 0 | 0 | 0 | 0 | 0 | 0 | 0 | 2 | 2 | 0 |
| Adherence | – | – | – | – | – | + | ++ | ++ | ++ | ++ | + | ++ | + | ++ | ++ |
| Gloss | matt | matt | matt | matt | matt | + | ++ | ++ | ++ | ++ | ++ | ++ | ++ | ++ | ++ |
| Homogeneity | inhom. | inhom. | inhom. | inhom. | inhom. | + | ++ | ++ | ++ | ++ | ++ | ++ | ++ | ++ | ++ |
| Colour | d'br | d'br | d'br | d'br | d'br | Cu-f | Cu-f | Cu-f | Cu-f | Cu-f | Cu-f | Cu-f | Cu-f | Cu-f | Cu-f |
| Layer | * | * | * | * | * | + | ++ | ++ | ++ | ++ | ++ | ++ | ++ | ++ | ++ |

In all the comparison examples the adherence was extremely low since the copper coat could already be wiped off with a damp linen cloth. The degree of inhomogeneity or homogeneity is indicated inter alia by the number of "stars". "inhom." denotes an inhomogeneous coppering, while "*" denotes a non-closed coating. The colour of the copper coat was dark brown (d'br in the comparison examples) instead of the typical copper colour (Cu-f).

It was surprisingly found that even a comparatively very high bromide content did not have an interfering effect. All the copper coatings obtained according to the invention were smooth, closed, shiny and of a typical copper colour and adhered well. However, in this series of experiments it was found that the adherence of the copper coat that had been produced in the presence of chloride ions was even slightly better than without a content of chloride ions.

TABLE 2

Coppering behaviour depending on temperature and time in a bath based on Example 10, and properties of the coppered wires. SG = layer weight of the copper coat. Examples 11-24 relate to dipping and Examples 25-36 relate to the throughflow process.

| | Example | | | | | | | | | | | | | |
|---|---|---|---|---|---|---|---|---|---|---|---|---|---|---|
| | B 11 | B 12 | B 13 | B 14 | B 15 | B 16 | B 17 | B 18 | B 19 | B 20 | B 21 | B 22 | B 23 | B 24 |
| Temp. in ° C. | 30 | 30 | 30 | 30 | 40 | 40 | 40 | 50 | 50 | 50 | 50 | 60 | 60 | 60 |
| Time in min. | 2 | 5 | 10 | 15 | 2 | 5 | 10 | 1 | 2 | 5 | 10 | 2 | 5 | 10 |
| Time in sec. | | | | | | | | | | | | | Dipping | |
| SG in g/m$^2$ | 4.0 | 8.3 | 13.4 | 17.4 | 8.0 | 13.5 | 21.6 | 4.6 | 7.8 | 18.8 | 22.9 | 5.4 | 12.6 | 21.0 |
| Adherence | ++ | ++ | ++ | ++ | ++ | ++ | ++ | ++ | ++ | ++ | ++ | ++ | ++ | ++ |
| Gloss | ++ | ++ | ++ | ++ | ++ | ++ | ++ | ++ | ++ | ++ | ++ | ++ | ++ | ++ |
| Homogeneity | ++ | ++ | ++ | ++ | ++ | ++ | ++ | ++ | ++ | ++ | ++ | ++ | ++ | ++ |
| Colour | Cu-f | Cu-f | Cu-f | Cu-f | Cu-f | Cu-f | Cu-f | Cu-f | Cu-f | Cu-f | Cu-f | Cu-f | Cu-f | Cu-f |
| Layer | ++ | ++ | ++ | ++ | ++ | ++ | ++ | ++ | ++ | ++ | ++ | ++ | ++ | ++ |

| | Example | | | | | | | | | | | |
|---|---|---|---|---|---|---|---|---|---|---|---|---|
| | B 25 | B 26 | B 27 | B 28 | B 29 | B 30 | B 31 | B 32 | B 33 | B 34 | B 35 | B 36 |
| Temp. in ° C. | 40 | 40 | 40 | 40 | 50 | 50 | 50 | 50 | 60 | 60 | 60 | 60 |
| Time in min. | | | | Throughflow Process | | | | | | | | |
| Time in sec. | 7.5 | 15 | 30 | 60 | 7.5 | 15 | 30 | 60 | 7.5 | 15 | 30 | 60 |
| SG in g/m$^2$ | 0.8 | 1.9 | 4.3 | 7.1 | 1.7 | 2.5 | 6.0 | 9.4 | 2.3 | 2.7 | 6.6 | 11.6 |
| Adherence | ++ | ++ | ++ | ++ | ++ | ++ | ++ | ++ | ++ | ++ | ++ | ++ |
| Gloss | ++ | ++ | ++ | ++ | ++ | ++ | ++ | ++ | ++ | ++ | ++ | ++ |
| Homogeneity | ++ | ++ | ++ | ++ | ++ | ++ | ++ | ++ | ++ | ++ | ++ | ++ |
| Colour | Cu-f | Cu-f | Cu-f | Cu-f | Cu-f | Cu-f | Cu-f | Cu-f | Cu-f | Cu-f | Cu-f | Cu-f |
| Layer | ++ | ++ | ++ | ++ | ++ | ++ | ++ | ++ | ++ | ++ | ++ | ++ |

Table 3: Coppering behaviour depending on temperature, time and dissolved $Fe^{2+}$ content in a bath based on Example 10, and properties of the coppered wires. SG=layer weight of the copper coat. Examples 41-55 relate to dipping and Examples 56-67 relate to the throughflow process.

TABLE 3

Coppering behaviour depending on temperature, time and dissolved $Fe^{2+}$ content in a bath based on Example 10, and properties of the coppered wires. SG = layer weight of the copper coat. Examples 41-55 relate to dipping and Examples 56-67 relate to the throughflow process.

| | Example | | | | | | | | |
|---|---|---|---|---|---|---|---|---|---|
| | B 41 | B 42 | B 43 | B 44 | B 45 | B 46 | B 47 | B 48 | B 49 |
| Temp. in ° C. | 30° C. - Simulation of dipping | | | | | | | | |
| Time in min. | 2 | 5 | 10 | 2 | 5 | 10 | 2 | 5 | 10 |
| SG in g/m$^2$ | 3.2 | 9.4 | 15.1 | 3.8 | 11.2 | 18.7 | 5.4 | 10.2 | 17.1 |
| $Fe^{2+}$ in g/l | 0 | 0 | 0 | 2 | 2 | 2 | 5 | 5 | 5 |
| Adherence | ++ | ++ | ++ | ++ | ++ | ++ | ++ | ++ | ++ |
| Gloss | ++ | ++ | ++ | ++ | ++ | ++ | ++ | ++ | ++ |
| Homogeneity | ++ | ++ | ++ | ++ | ++ | ++ | ++ | ++ | ++ |
| Colour | Cu-f | Cu-f | Cu-f | Cu-f | Cu-f | Cu-f | Cu-f | Cu-f | Cu-f |
| Layer | ++ | ++ | ++ | ++ | ++ | ++ | ++ | ++ | ++ |

TABLE 3-continued

Coppering behaviour depending on temperature, time and dissolved $Fe^{2+}$ content in a bath based on Example 10, and properties of the coppered wires. SG = layer weight of the copper coat. Examples 41-55 relate to dipping and Examples 56-67 relate to the throughflow process.

| | Example | | | | | | | | |
|---|---|---|---|---|---|---|---|---|---|
| | B 50 | B 51 | B 52 | B 53 | B 54 | B 55 | B 56 | B 57 | B 58 |
| Temp. in ° C. | 30° C. - Simulation of dipping | | | | | | 50° C. - Throughflow process | | |
| Time in min. | 2 | 5 | 10 | 2 | 5 | 10 | | | |
| Time in sec. | | | | | | | 7.5 | 15 | 30 |
| SG in g/m$^2$ | 3.8 | 6.7 | 12.3 | 4.4 | 4.5 | 12.3 | 1.7 | 2.5 | 6.0 |
| $Fe^{2+}$ in g/l | 10 | 10 | 10 | 20 | 20 | 20 | 0 | 0 | 0 |
| Adherence | ++ | ++ | ++ | ++ | ++ | ++ | ++ | ++ | ++ |
| Gloss | ++ | ++ | ++ | ++ | ++ | ++ | ++ | ++ | ++ |
| Homogeneity | ++ | ++ | ++ | ++ | ++ | ++ | ++ | ++ | ++ |
| Colour | Cu-f | Cu-f | Cu-f | Cu-f | Cu-f | Cu-f | Cu-f | Cu-f | Cu-f |
| Layer | ++ | ++ | ++ | ++ | ++ | ++ | ++ | ++ | ++ |

| | Example | | | | | | | | |
|---|---|---|---|---|---|---|---|---|---|
| | B 59 | B 60 | B 61 | B 62 | B 63 | B 64 | B 65 | B 66 | B 67 |
| Temp. in ° C. | 50° C. - Simulation of the throughflow process | | | | | | | | |
| Time in sec. | 60 | 7.5 | 15 | 30 | 60 | 7.5 | 15 | 30 | 60 |
| SG in g/m$^2$ | 9.4 | 1.5 | 2.1 | 2.6 | 6.7 | 1.6 | 2.1 | 3.1 | 4.8 |
| $Fe^{2+}$ in g/l | 0 | 10 | 10 | 10 | 10 | 20 | 20 | 20 | 20 |
| Adherence | ++ | ++ | ++ | ++ | ++ | ++ | ++ | ++ | ++ |
| Gloss | ++ | ++ | ++ | ++ | ++ | ++ | ++ | ++ | ++ |
| Homogeneity | ++ | ++ | ++ | ++ | ++ | ++ | ++ | ++ | ++ |
| Colour | Cu-f | Cu-f | Cu-f | Cu-f | Cu-f | Cu-f | Cu-f | Cu-f | Cu-f |
| Layer | ++ | ++ | ++ | ++ | ++ | ++ | ++ | ++ | ++ |

The adherence was tested in all experiments by vigorously wiping the coppered wires with a damp linen cloth. In this connection, no significant differences in adherence were found in the examples according to the invention. All the copperings according to the invention were completely satisfactory. Furthermore, with variations in the compositions and/or treatment conditions there was no deterioration of the adherence with particularly high temperatures and particularly long coppering times, as sometimes occurs in conventional coppering baths under these operating conditions. At a temperature of 30° C. and with a dipping time of up to 4 minutes the gloss is slightly less good than in the remaining dipped samples. The same also applies as regards the simulation of the throughflow units. The gloss in principle increases slightly with temperature and also slightly with dipping time or throughflow time, though the homogeneity may, depending on the circumstances, be slightly adversely affected at particularly high temperatures and particularly long coppering times, for example due to minute black spots. Apart from this the homogeneity of all samples according to the invention was at least as good, if not even in some cases even more uniform, than in conventional currentless coppering. All samples exhibited the typical copper colour in the same way. A closed, smooth, high-quality copper layer was always produced.

In the experiments according to the invention relating to copper deposition as a function of the iron content, a uniformly high quality as regards adherence, homogeneity, copper coat and deposition quality was found in all samples. Only the gloss of the samples exhibited a slight deterioration in some cases with iron contents of 20 g/l and above, particularly with longer coppering times. With the samples that had been coppered on the one hand by dipping, and on the other hand by the throughflow process with 90 or 110 g/l of $Fe^{2+}$ dissolved in the bath, the gloss was noticeably less good but was always still adequate, although the coppering was satisfactory apart from the bath behaviour and the other properties. The gloss is in any case not so important in the coppering of wires since the wires always in addition have to be drawn after the coppering and the coppering layer is thereby improved still further as regards gloss.

The invention claim is:

1. An aqueous composition comprising water;

copper hydroxycarbonate;

a copper complex-forming agent; and at least one complexed water-soluble or water-dispersible copper complex formed by complexing of said copper complex forming agent and a copper ion from said copper hydroxycarbonate.

2. The aqueous composition according to claim 1, wherein at least 40 wt.% of the total amount of copper from said copper hydroxycarbonate is complexed.

3. An aqueous composition according to claim 1, wherein the complexing agent is selected from the group consisting of monohydroxycarboxylic, acid, dihydroxycarboxylic acid, trihydroxycarboxylic acid, polyhydroxycarboxylic acid, phosphonic acid, diphosphonic acid and derivatives thereof.

4. An aqueous composition according to claim 1 that is stable to freezing and thawing down to a temperature of at least −8° C.

5. An aqueous composition according to claim 1, having a copper content in the range from 3 to 200 g/l Cu.

6. The aqueous composition according to claim 1 adjusted to a pH value in the range from 4 to 11.

7. The aqueous composition of claim 1 further comprising at least one brightening agent.

8. The aqueous composition of claim 1 further comprising a residue of basic copper carbonate.

9. The aqueous composition of claim 1 having a pH value of less than 2.5.

10. The aqueous composition according to claim 9 wherein at least 40 wt.% of the contained copper compounds are complexed.

11. The aqueous composition according to claim 9 having a copper content in the range from 0.05 to 120 g/l.

12. The aqueous composition according to claim 9, further comprising iron wherein the iron content is up to at least 90 g/l $Fe^{2+}$.

13. The aqueous composition according to claim 9, further comprising iron wherein the iron content is up to at least 110 g/l $Fe^{2+}$.

14. The aqueous composition according to claim 9 wherein the copper complex forming agent is selected from the group consisting of monohydroxycarboxylic acid, dihydroxycarboxylic acid, trihydroxycarboxylic acid, polyhydroxycarboxylic acid, phosphonic acid, diphosphonic acid or a derivative thereof.

* * * * *